US012448796B2

(12) United States Patent
Melic

(10) Patent No.: US 12,448,796 B2
(45) Date of Patent: Oct. 21, 2025

(54) EDGE PROTECTION SYSTEM

(71) Applicant: Jonathan Jonny Melic, Burlington (CA)

(72) Inventor: Jonathan Jonny Melic, Burlington (CA)

( * ) Notice: Subject to any disclaimer, the term of this patent is extended or adjusted under 35 U.S.C. 154(b) by 307 days.

(21) Appl. No.: 18/340,840

(22) Filed: Jun. 24, 2023

(65) Prior Publication Data

US 2023/0417073 A1 Dec. 28, 2023

Related U.S. Application Data

(60) Provisional application No. 63/355,776, filed on Jun. 27, 2022.

(51) Int. Cl.

| | |
|---|---|
| ***E04G 21/32*** | (2006.01) |
| ***E04H 17/02*** | (2006.01) |
| ***E04H 17/04*** | (2006.01) |
| ***E04H 17/08*** | (2006.01) |

(52) U.S. Cl.

CPC ..... *E04G 21/3233* (2013.01); *E04H 17/05* (2021.01); *E04H 17/08* (2013.01); *E04H 17/127* (2021.01)

(58) Field of Classification Search

CPC ..... E04G 21/32; E04G 21/30204; E04G 21/3214; E04G 21/3223; E04G 21/3228; E04G 21/3261; E04G 21/3266; E04G 21/3233; E04H 17/05; E04H 17/08; E04H 17/16; E04H 17/161; E04H 17/127

See application file for complete search history.

(56) References Cited

U.S. PATENT DOCUMENTS

| | | | | | |
|---|---|---|---|---|---|
| 4,982,813 | A * | 1/1991 | Starr | E04G 21/3261 | 182/138 |
| 4,986,389 | A * | 1/1991 | Halligan, Sr. | E04G 21/28 | 182/138 |
| 6,068,085 | A * | 5/2000 | Denny | E04G 21/3266 | 182/138 |
| 6,098,750 | A * | 8/2000 | Reynolds | E04G 21/3261 | 182/138 |

(Continued)

FOREIGN PATENT DOCUMENTS

| | | | | |
|---|---|---|---|---|
| GB | 2420818 A * | 6/2006 | ..... | E04G 21/3223 |
| KR | 20100030720 A * | 3/2010 | ..... | F16G 11/12 |

(Continued)

*Primary Examiner* — Jonathan P Masinick

(74) *Attorney, Agent, or Firm* — Crowe & Dunlevy, P.C.

(57) ABSTRACT

A safety fence comprising a first and a second post. An upper rail is securable to upright members of the first post and the second post in a horizontally orientation. A mesh has an upper end slidably coupled to the upper rail. The mesh has a retracted configuration where it is collapsed and retained next to the first post, and a deployed configuration where it is extended between the first and second posts in a taut configuration. At least one tensioning member has a first end fixed to the first post and is releasably securable to the second post such that the tensioning member may be tensioned between the first and second posts. The tensioning member, when tensioned between the first and second posts with the mesh in its deployed configuration, provides horizontal load support to the mesh.

20 Claims, 17 Drawing Sheets

(56) References Cited

U.S. PATENT DOCUMENTS

| | | | | |
|---|---|---|---|---|
| 6,186,274 | B1 * | 2/2001 | Reynolds | E04G 21/3261 182/138 |
| 7,014,053 | B2 * | 3/2006 | Calleja | F16P 1/00 182/138 |
| 9,731,640 | B1 * | 8/2017 | Meacham | B60R 3/005 |
| 10,842,270 | B2 * | 11/2020 | Clarke | B65G 1/02 |
| 10,961,731 | B2 * | 3/2021 | Melic | F16B 13/0858 |
| 10,982,454 | B2 * | 4/2021 | Melic | E04G 21/3223 |
| 12,012,769 | B2 * | 6/2024 | Melic | E04G 21/3266 |
| 2009/0159369 | A1 * | 6/2009 | McCarthy | E04G 21/3266 182/222 |
| 2012/0055738 | A1 * | 3/2012 | Larkin | E04G 21/3266 182/138 |
| 2021/0108430 | A1 * | 4/2021 | Melic | E04G 21/3266 |
| 2021/0189759 | A1 * | 6/2021 | Rainville | E04G 21/3233 |

FOREIGN PATENT DOCUMENTS

| | | | | |
|---|---|---|---|---|
| KR | 101022463 | B1 * | 3/2011 | E04G 21/3266 |
| KR | 101209190 | B1 * | 12/2012 | |
| KR | 101224606 | B1 * | 1/2013 | |
| KR | 101270731 | B1 * | 6/2013 | |

* cited by examiner

4

11
7
"A"
7
4
"B"
12
2

14
7
9

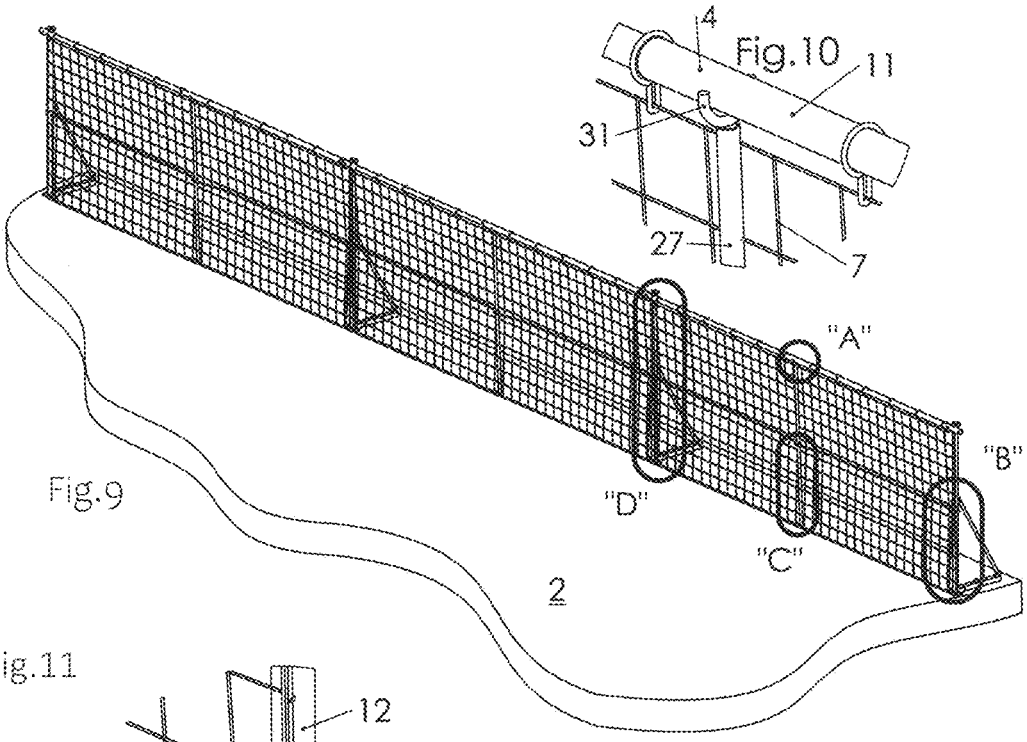
Fig.9
Fig.11
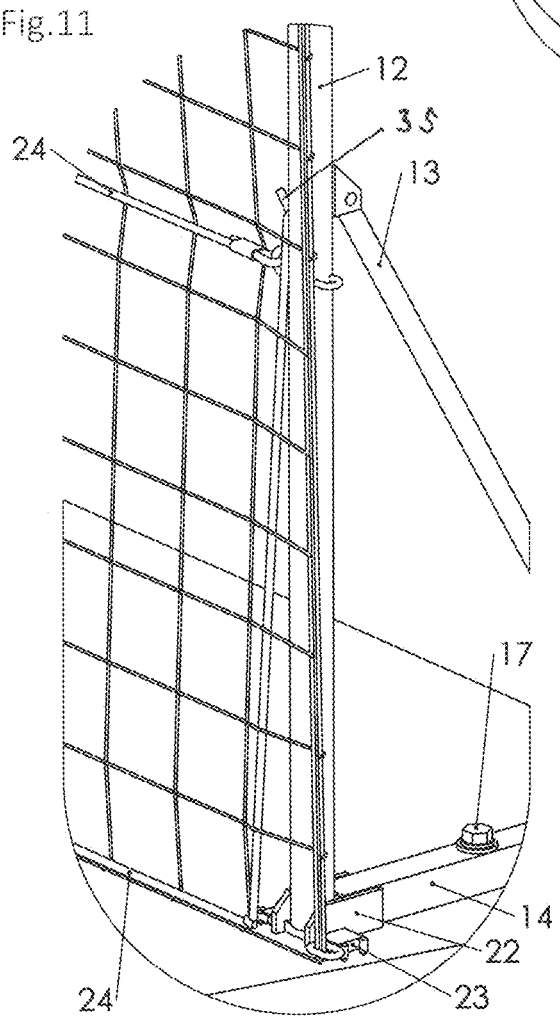
Fig.12
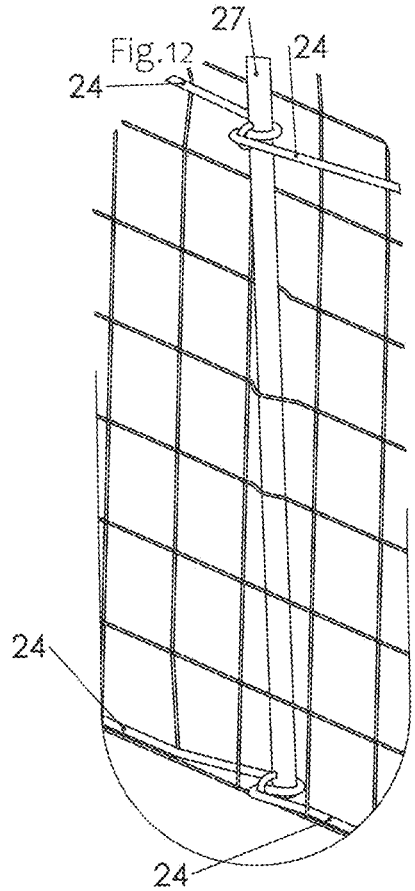

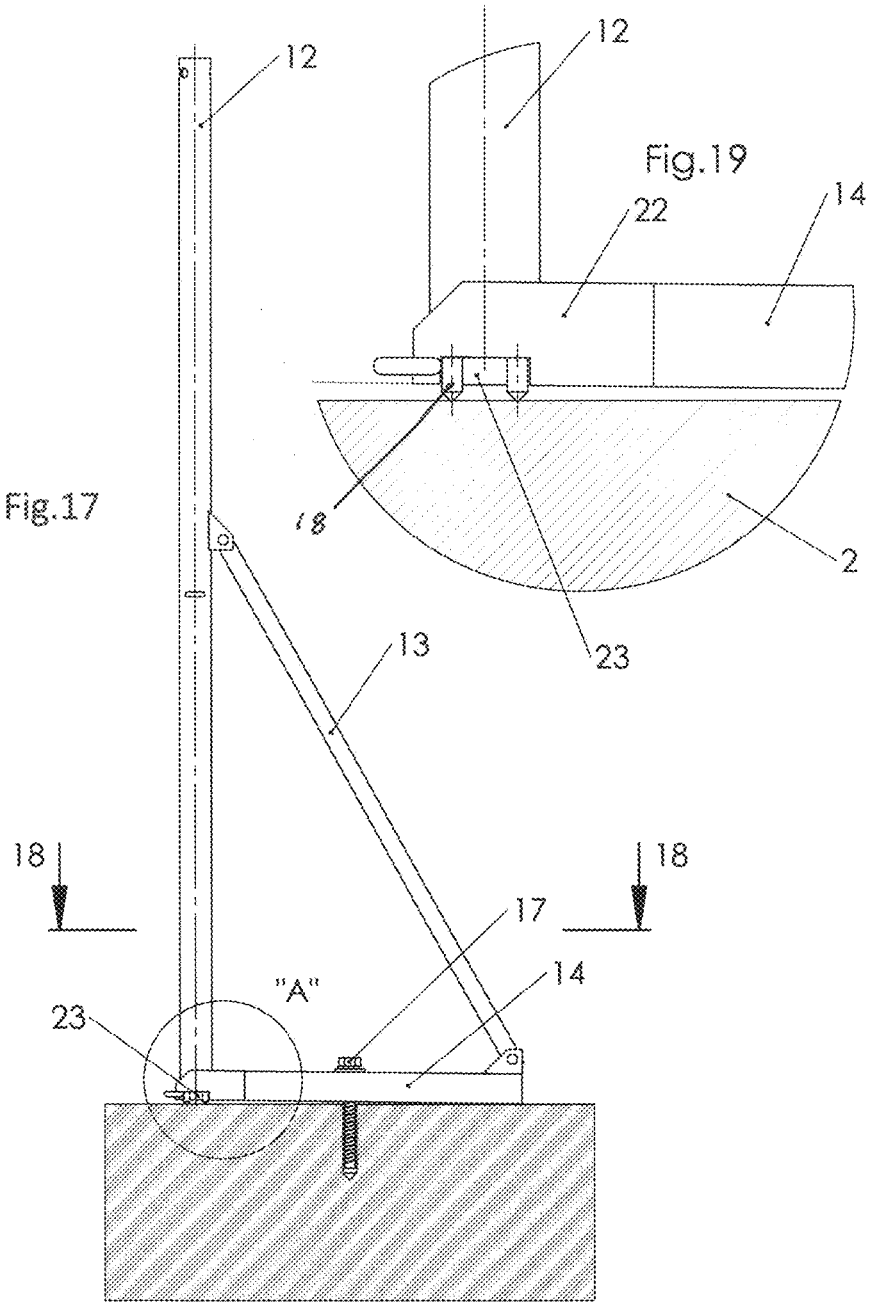
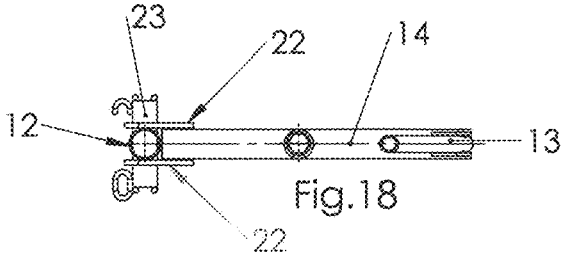
Fig.18

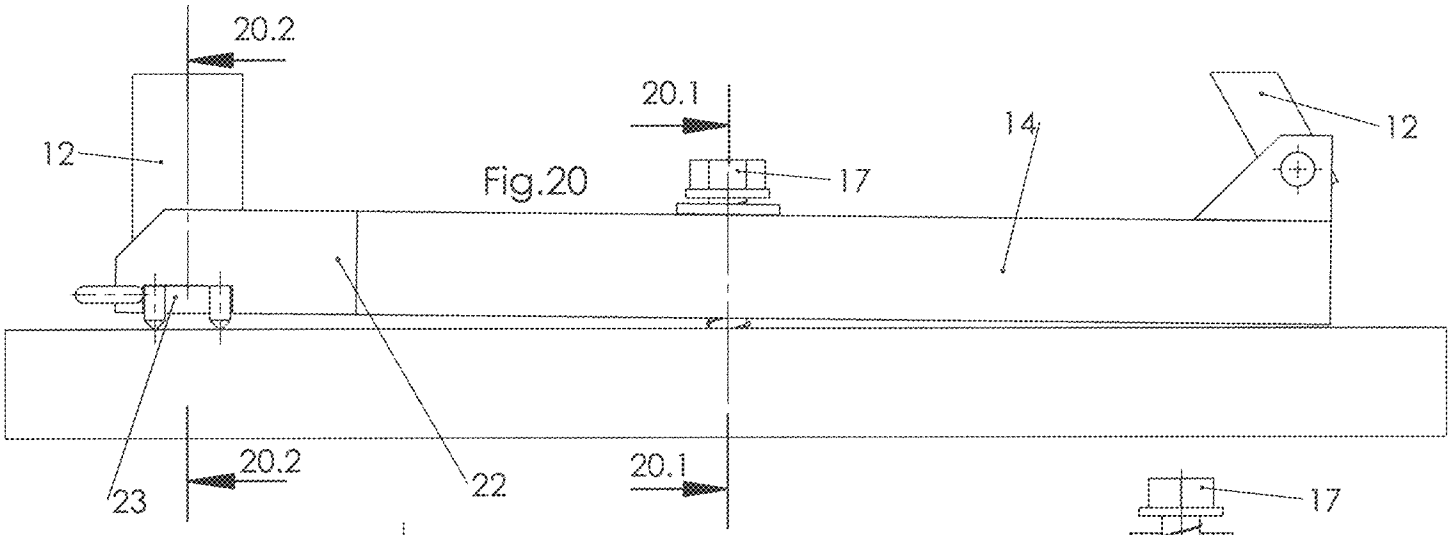
Fig.20
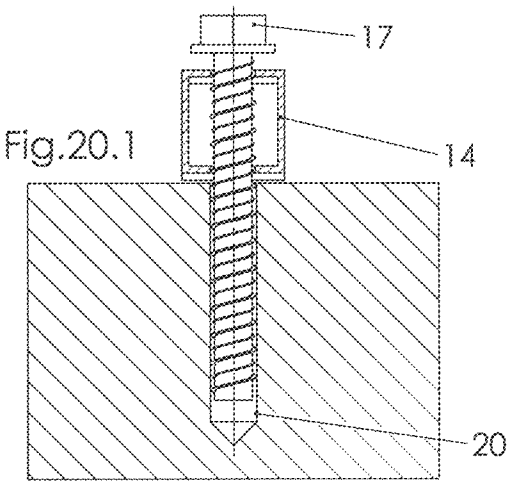
Fig.20.1
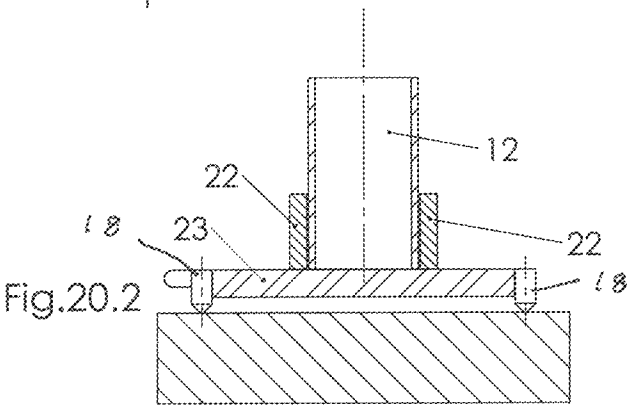
Fig.20.2

Fig.22
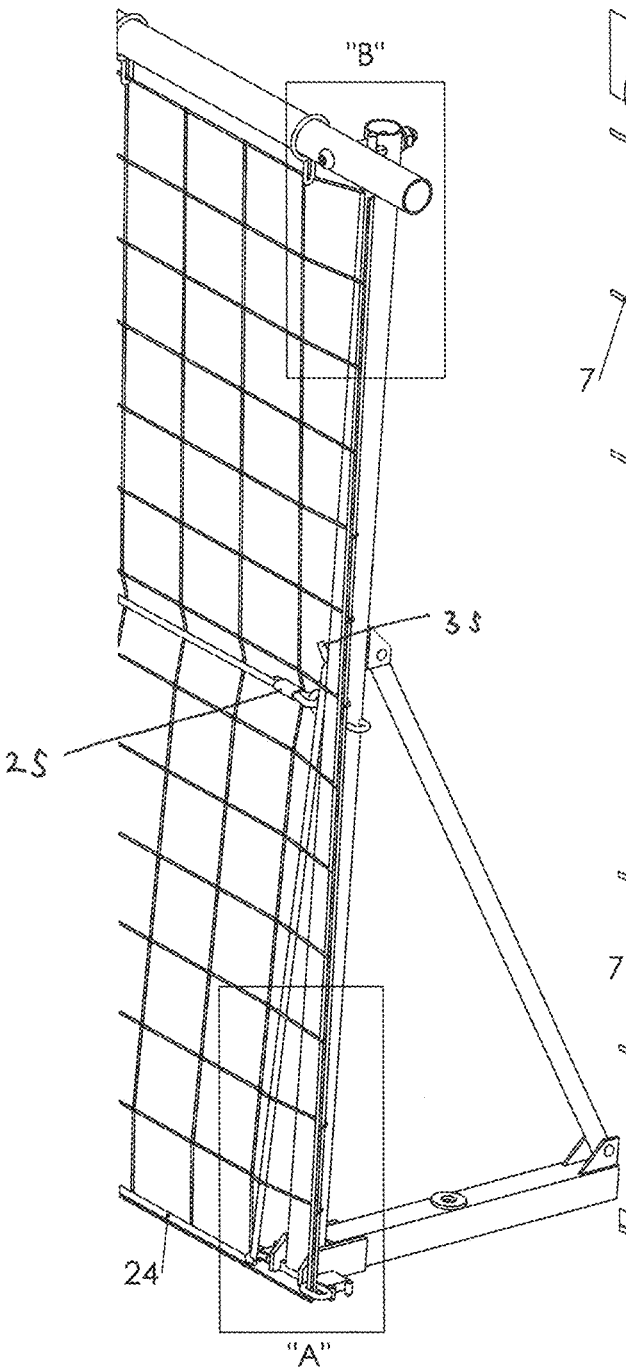
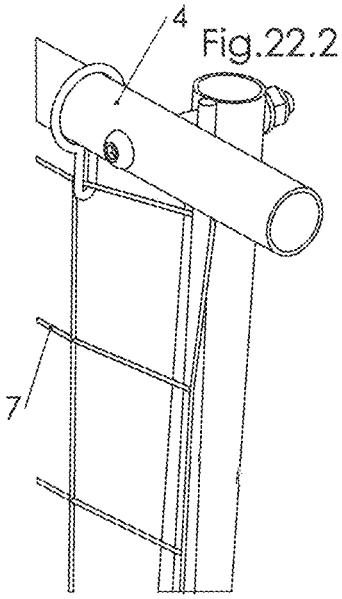
Fig.22.2
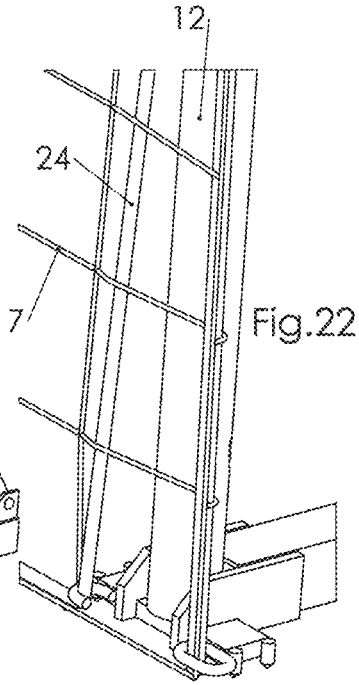
Fig.22.1

EDGE PROTECTION SYSTEM

FIELD

This invention relates generally to the field of edge protection systems, such as those used in the construction of multi-story buildings or high-rise construction. In an embodiment the invention concerns a safety fence or a safety barrier, and to a post for use in constructing a safety fence or barrier, for use in edge protection and other applications.

BACKGROUND

During the construction of multi-story buildings, and in particular high-rise office buildings, apartments, and condominiums, it is often a legal requirement to install a safety fence or barrier about the perimeter of a floor under construction. Such fences or barriers serve to help prevent people, equipment, construction materials, and other items from falling off the edge of a building during its construction. The safety fences or barrier systems that are currently employed typically include a plurality of posts that support fence panels in various ways. The fences or barrier systems are preferably relatively easy to erect and to take down, and in many cases are designed to be moved from location to location, or from floor to floor, so that they may be re-used during the building's construction.

Others have proposed a wide variety of different fence or barrier systems for use in multi-story building construction. Many employ posts that extend between adjacent floor structures to "anchor" fence panels in place. Others require bolting or otherwise securing posts to the floor of a building under construction and then attaching relatively large fence panels between adjacent posts.

While many attempts have been made to improve the design of such safety fences or barrier systems, there continues to remain a need for systems that can be easily and quickly set up and subsequently taken down to be moved to different locations, that are lightweight so that they can be easily transported and maneuvered by hand, and that are economical to manufacture, transport, store and utilize.

SUMMARY OF THE INVENTION

In one aspect the invention provides a safety fence, the safety fence comprising a first post and a second post, each post releasably securable to a floor structure of a building or to another surface, an upper rail having a first end rotationally secured to an upright member of the first post, the upper rail having a second end releasably securable to an upright member of the second post to form a generally horizontally oriented support rail extending between the first and the second posts, the upper rail rotationally moveable about the first post to facilitate fence erection, removal, transportation, and storage, a collapsible mesh having an upper portion slidably coupled to the upper rail and having a first end fixedly secured to the first post, the mesh having a retracted configuration wherein it is collapsed and retained generally adjacent to the first post, the mesh having a deployed configuration wherein it has been slid along the upper rail such that the mesh is extended between the first and second posts with a second end releasably secured to the second post, the mesh slidably movable between its retracted and deployed configurations to facilitate fence erection, removal, transportation, and storage, at least one tensioning member having a first end fixed to the first post, the tensioning member releasably receivable with the second post such that the tensioning member may be tensioned between the first and second posts, when tensioned between the first and second posts with the mesh in its deployed configuration, the tensioning member providing horizontal load support to the mesh, the tensioning member extendible and retractable between the first and second posts to facilitate fence erection, removal, transportation, and storage.

In another aspect the invention provides a post for use in a safety fence, the post comprising an upright member releasably securable to a floor of a building or to another surface, an upper rail rotatably securable to the upright member such that the upper rail is rotatable to form a generally horizontally oriented support rail extending between the upright member and an adjacent post which is also releasably secured to the floor of the building or other surface, a collapsible mesh having an upper end slidably coupled to the upper rail, the mesh having a retracted configuration wherein it is collapsed and retained generally adjacent to the upright member, the mesh having a deployed configuration such that when the upper rail is horizontally oriented and extends to an adjacent post, the mesh is extended between the upright member and the adjacent post, at least one tensioning member having a first end fixed to the upright member and releasably securable to the adjacent post such that the tensioning member may be tensioned between the upright member and the adjacent post providing horizontal load support to the mesh when the mesh is in its deployed configuration.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which:

FIG. 9 is a view subsequent to FIG. 7, wherein the fence has been fully erected.

FIG. 10 is an enlarged detailed view of portion "A" of FIG. 9.

FIG. 11 is an enlarged detailed view of portion "B" of FIG. 9.

FIG. 12 is an enlarged detailed view of portion "C" of FIG. 9.

FIG. 17 is view subsequent to FIG. 16, wherein the fence post is in a fully extended configuration and is shown mounted to a floor surface.

FIG. 18 is a horizontal sectional view taken along the line 18-18 of FIG. 17.

FIG. 19 is an enlarged detail view of portion "A" of FIG. 17.

FIG. 20 is a side elevational view of the lower portion of a fence post, in accordance with an embodiment of the invention, mounted upon a floor of a building.

FIG. 20.1 is a vertical sectional view taken along the line 20.1-20.1 of FIG. 20.

FIG. 20.2 is a vertical sectional view taken along the line 20.2-20.2 of FIG. 20.

FIG. 21.1 is a vertical sectional view taken along the line 21.1-21.1 of FIG. 21.

FIG. 21.2 is a vertical sectional view taken along the line 21.2-21.2 of FIG. 21.

FIG. 22 is a partial right side perspective view of the fence shown in FIG. 1.

FIG. 22.1 is an enlarged detail view of portion "A" of FIG. 22.

FIG. 22.2 is an enlarged detail view of portion "B" of FIG. 22.

DESCRIPTION OF EXAMPLE EMBODIMENTS

Figure 1:
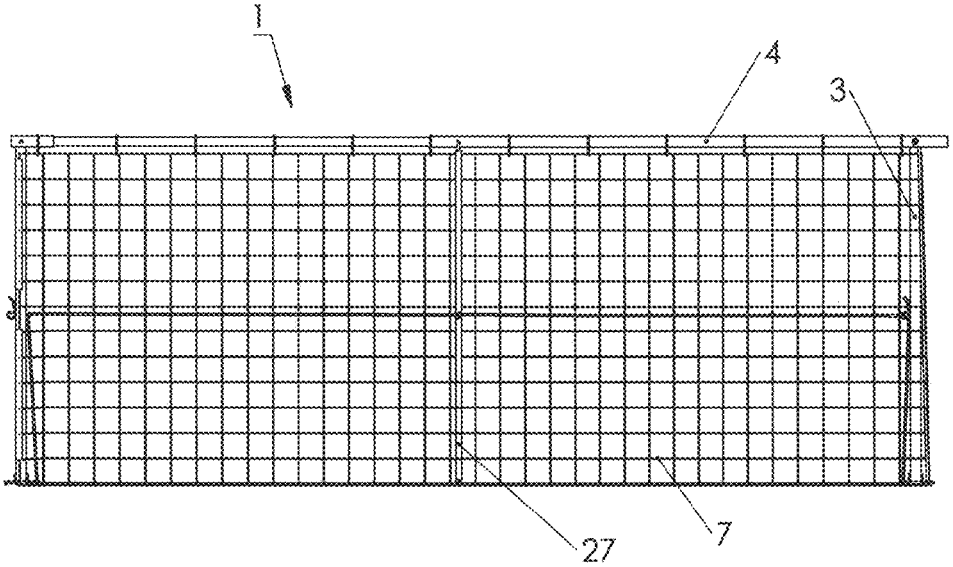
FIG. 1 is a side elevational view of an erected safety fence constructed in accordance with an embodiment of the invention.

The present invention may be embodied in a number of different forms. The specification and drawings that follow describe and disclose some of the specific forms of the invention.

With reference to the attached drawings, there are depicted embodiments of a safety fence 1 constructed in accordance with the invention. While safety fence 1 could be used in a variety of different applications, it is expected that in most instances it would be used as an edge protection system on a floor 2 that is under construction in a multi-story or high-rise building. That is, while the application of the invention is described for use in association with a floor under construction, any one of a wide variety of other applications, both construction and non-construction based, are contemplated. Typically, fence 1 would be erected along the outer edge of floor 2 in order to help prevent individuals, equipment and materials from inadvertently falling off the side of the floor. To that end, fence 1 is designed such that it can be erected in place, used for a desired length of time, disassembled, moved to another floor or other location, and then erected again for subsequent use. To assist in that regard, fence 1, in its disassembled state, is preferably relatively light and compact, and is of a design that facilitates a fast and simple installation and removal.

The embodiment of fence 1 shown in the attached drawings is comprised of a plurality of upright post members 3 that are each releasably securable to floor 2. Fence 1 further includes an upper rail 4 that is secured, or that is securable to, a first post 5, and that is securable to a second post 6 in order to form a generally horizontally oriented support rail that extends between the two posts. A collapsible mesh or barrier 7 has an upper portion 8 that is slidably coupled to rail 4, and a bottom or lower portion 9 that, when fence 1 is in its erected configuration, is adjacent to or rests upon the surface of floor 2 (or other surface where fence 1 is used in an application other than high-rise construction). Mesh 7 has a retracted configuration, wherein it is collapsed and folded or otherwise "bunched" together generally adjacent to first post 5. Mesh 7 further has a deployed configuration where it is extended between first post 5 and second post 6 with its upper portion 8 slidably coupled to rail 4 and with lower and/or bottom 9 adjacent to the upper surface of floor 2. In one configuration, upper portion 8 of mesh 7 may include a generally horizontally oriented sleeve through which rail 4 passes to "hang" the mesh from the rail and to permit the mesh to be slid along the length of the rail. In another configuration a series of rings 11 are secured to upper portion 8 and are slidably received over rail 4. Regardless of how mesh 7 is slidably secured to rail 4, when fence 1 is fully erected, one end of the mesh will be fixed or secured to first post 5 with the opposite end of the mesh releasably securable to second post 6, effectively presenting a generally vertically-oriented barrier between the respective posts. In the fully erected configuration of fence 1, mesh 7 will be secured in a relatively taut manner between posts 5 and 6. Posts 5 and 6 may be equipped with hooks or other mechanical structures to secured the ends of mesh 7 thereto.

From a thorough understanding of the invention it will be appreciated that mesh 7 could take a wide variety of different constructions and could be formed from a variety of different materials. In a preferred embodiment mesh 7 is a wire or synthetic open weave mesh, such as that shown in the attached drawings. It has been determined that an open weave mesh can provide adequate horizontal load capacity while presenting a structure that can more readily accommodate wind loading by means of the openings provided by its open weave nature.

Figure 3:
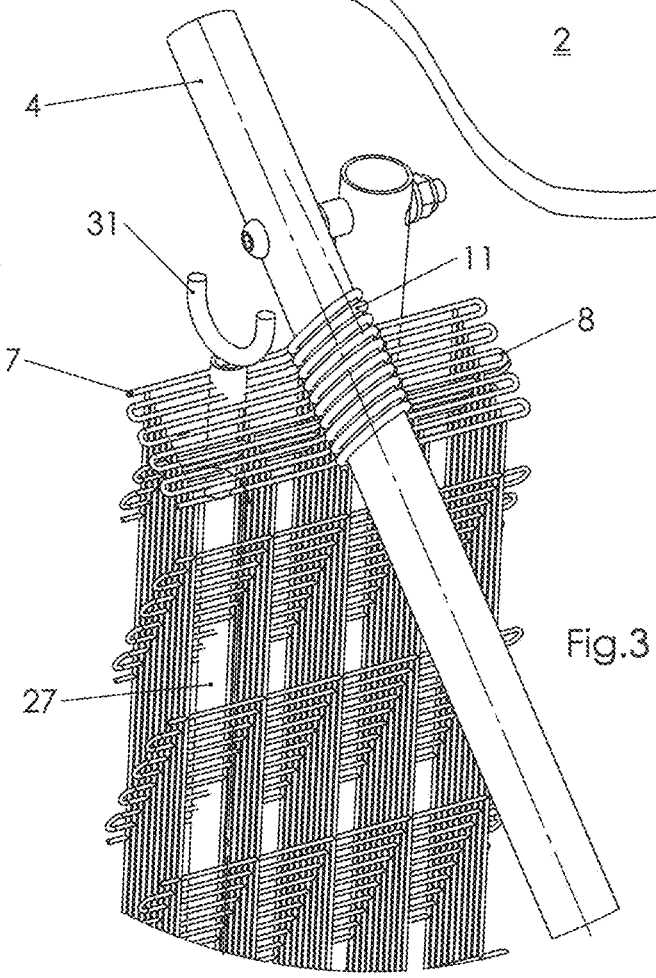
FIG. 3 is an enlarged detailed view of portion "A" of FIG. 2.

An embodiment of post 3 is shown in detail in FIGS. 14 through 19. In this embodiment post 3 is comprised generally of an upright member 12 to which the ends of rail 4 may be secured. In the embodiment shown, one end of rail 4 is rotatably secured to the upper portion of upright 12 (see in particular FIG. 3) such that the rail may be rotated and stowed in a position that is generally parallel to upright 12 for transport. Post 3 may further comprise an angular brace 13 and a bottom support 14. Brace 13 will typically extend from a position that is part-way along the length of upright 12, rearwardly to a point that is offset from the lower end of upright 12. A first end 15 of bottom support 14 may be hingedly secured to the outer end of brace 13, with the opposite end 16 of bottom support 14 releasably securable to the bottom end of upright 12.

Figure 14:
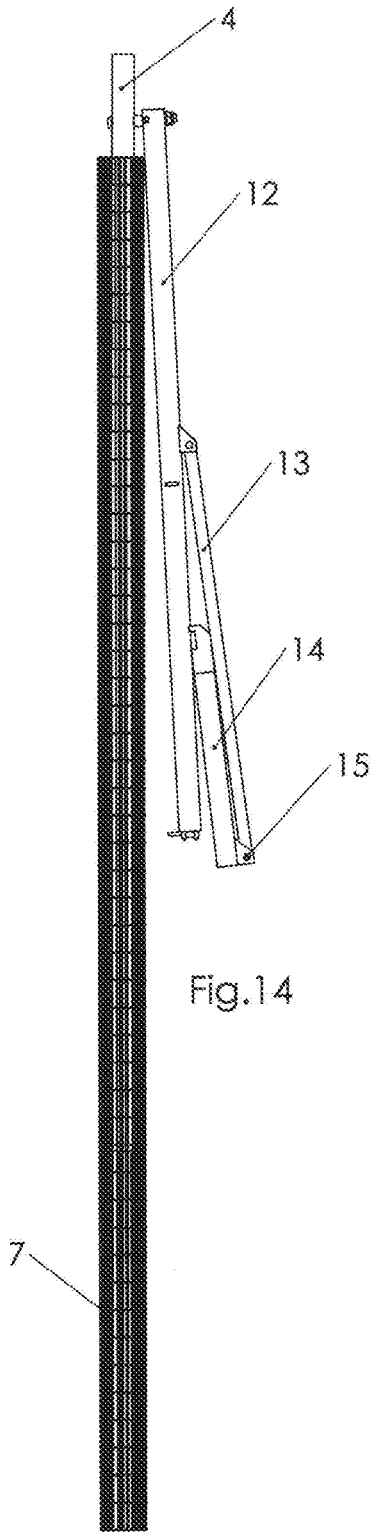
FIG. 14 is a side elevational view of a fence post of an embodiment of the invention with its retractable barrier material in a collapsed state.
Figure 15:
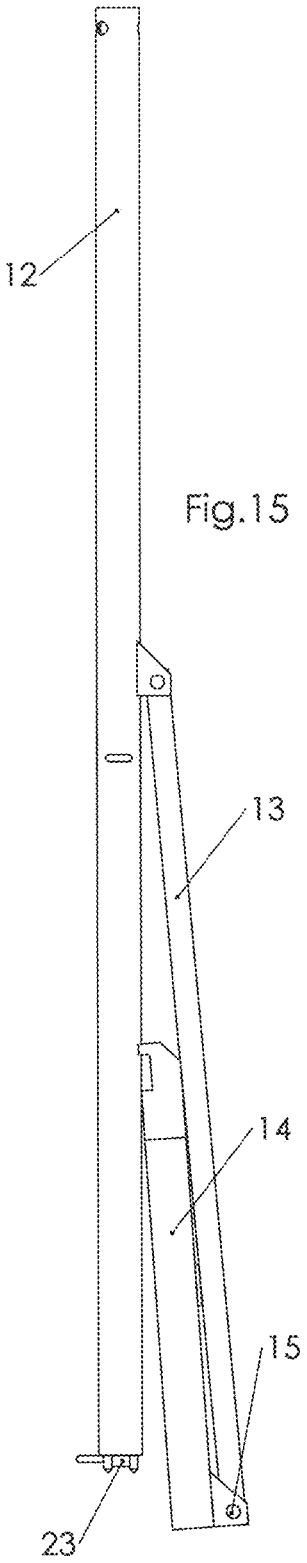
FIG. 15 is a view similar to FIG. 14, wherein the barrier material having been removed to better illustrate portions of the post.
Figure 16:
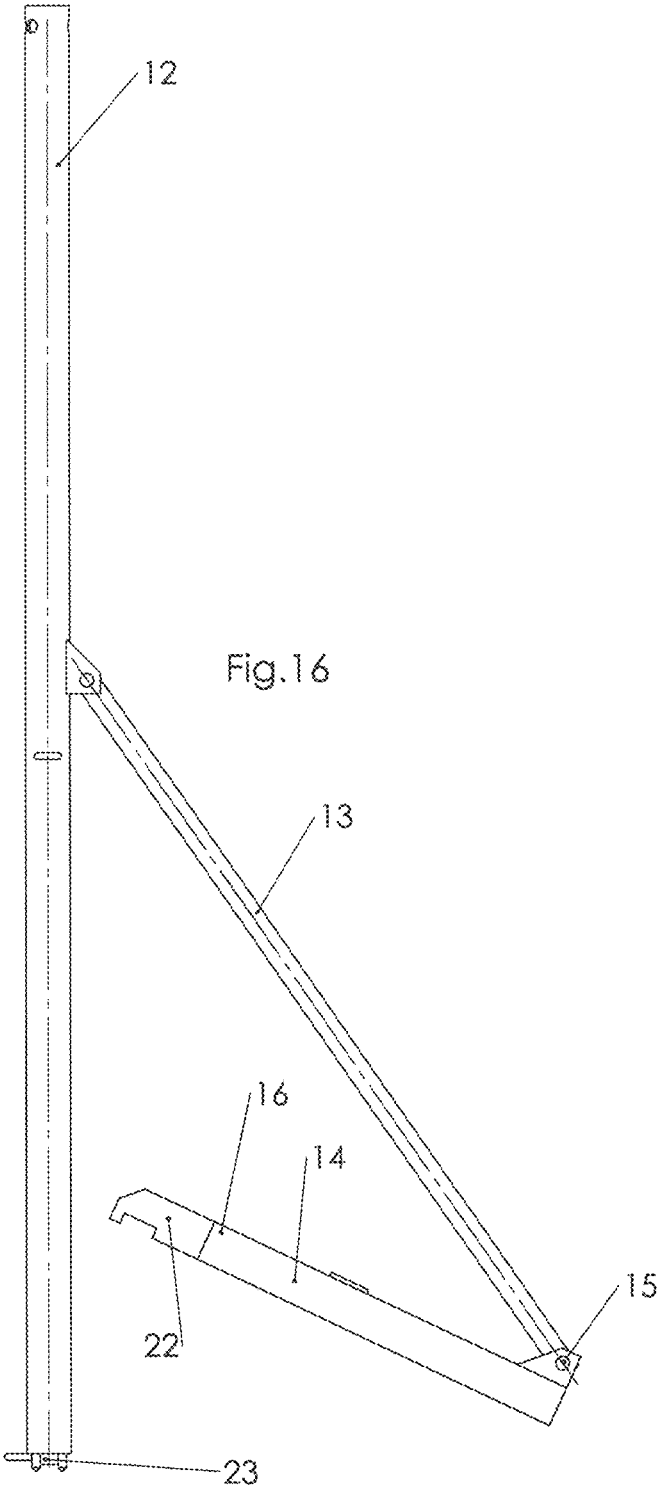
FIG. 16 is a view subsequent to FIG. 15, wherein the fence post is in a partially extended configuration.

The described structure of post 3 permits end 16 of bottom support 14 to be disengaged from upright 12, allowing for a rotation of end 15 of bottom support 14 relative to brace 13 in order to allow the brace and the bottom support to be moved from an extended or engaged configuration to a "folded" or collapsed configuration where they are generally adjacent to and parallel to upright 12. Such an embodiment is shown in FIGS. 14 and 15. In the case of FIG. 14, mesh 7 is shown in its retracted configuration, adjacent to upright 12. Post 3 and mesh 7 may thus be configured in a manner that is relatively compact for purposes of transport and storage.

When deployment of fence 1 is desired, an installer need to merely rotate bottom support 14 into a position wherein end 16 is engaged with the lower end of upright 12 and maintained generally perpendicular thereto, following which a fastener 17 can be inserted through bottom support 14 into floor 2 to hold the post in place. The post will thus be secured to floor 2, with upright 12 in a generally vertical orientation. The operation of bottom support 14 and angle brace 13 provide horizontal rigidity to the post.

Fastener 17 may take any one of a wide variety of different fastening mechanisms that are known or available for securing posts and other such materials to floor 2 (or other surface as the case may be). In the embodiment shown, fastener 17 is an anchor bolt having a lower-end that engages a bore 20 within floor 2. It will be appreciated that in some instances the anchor bolt may engage bore 20 directly, while in other instances an expansion anchor could be utilized. Tensioning fastener 17 will draw bottom support 14 into contact with the upper surface of floor 2, securing bottom support 14 tightly against the floor surface. It will also be understood that various other forms of anchoring means could equally be utilized. For example, bottom support 14 could be secured to floor 2 through the use of a mechanical clamp that is engaged about the upper and lower surface of the floor, through the use of adhesives or other forms of fasteners, or through the use of a vertical tensioning post that is tensioned between bottom support 14 and the bottom surface of a floor immediately above.

Different means to releasably secure end 16 of bottom support 14 to the bottom or lower portion of upright 12 are contemplated. In the attached drawings, end 16 of bottom support 14 is fitted with a pair of hook-like members 22 that are releasably receivable over a generally horizontally oriented foot 23 at the base of upright 12 (see FIGS. 17 and 18). Securing fastener 17 within bore 20 will retain hook-like members 22 in their position over foot 23, thereby securing upright 12 to floor 2 and maintaining upright 12 in a generally vertical orientation.

In an embodiment of the invention, foot 23 and/or bottom support 14 may have a cambered lower surface. Tightening the fastener will thus compress the cambered surface of foot 23 and/or bottom support 14 against floor 2. Compressing the cambered surface tends to partially flatten it, inducing a stress that tends to more securely hold upright 12 rigidly in place. Compressing the cambered foot against the surface of floor 2 will also tend to ensure a multiple point contact between the bottom support/foot structure and the floor surface, which will tend to help prevent "wobbling" of the post. In this manner, upright 12, and hence post 3 in general, may be securely held in position on floor 2 with a reduced likelihood of movement or wobbling or rattling, particularly when the post is exposed to wind loading.

Figure 21:
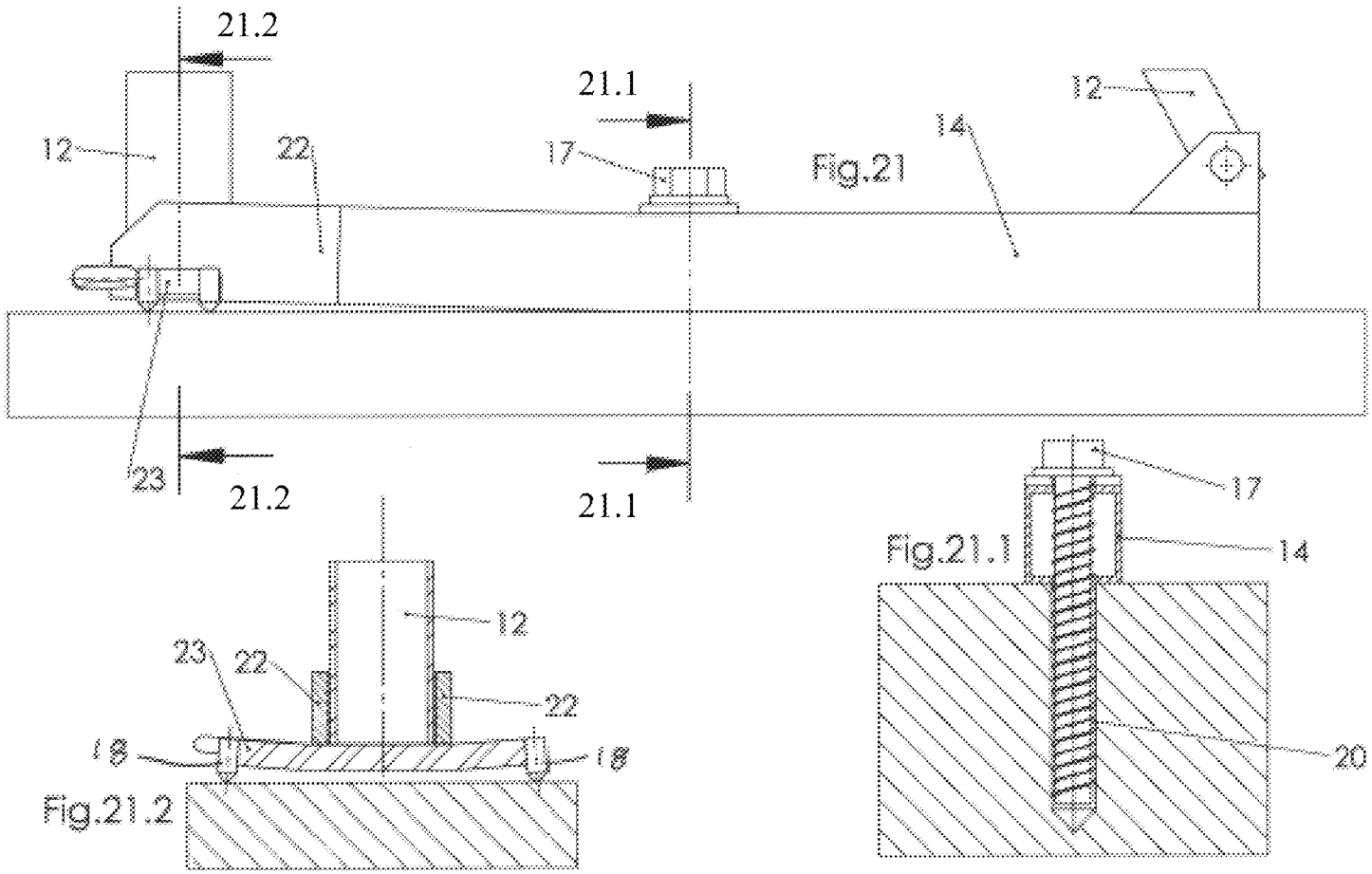
FIG. 21 is a view similar to FIG. 20 where the fastener has been tightened to draw the bottom support of the fence post toward the floor surface.
Figure 23:
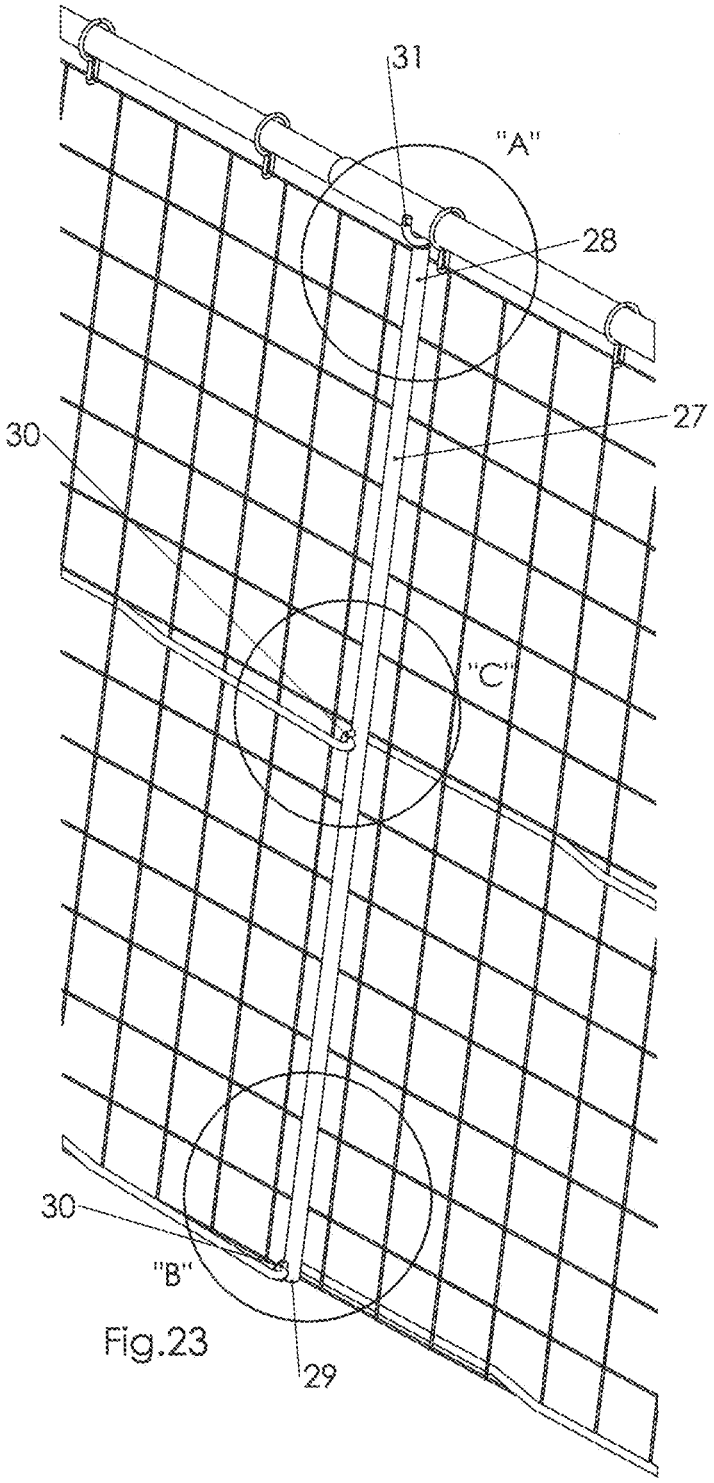
FIG. 23 is a partial upper side perspective view of the middle portion of the fence shown in FIG. 1.

In an alternate embodiment, bottom support 14 may exhibit a degree of inclination when post 3 is initially placed upon a floor surface and before fastener 17 is tightened. That is, end 16 of bottom support 14 may rest on foot 23, causing the bottom support to be inclined in a direction toward foot 23 (see FIG. 20). Thereafter, when fastener 17 is tightened, bottom support 14 may be compressed downwardly toward the upper surface of floor 2 (see FIG. 21). At that point the bottom support will not only be secured to the floor, but it will also be in a stressed condition, which will help to securely hold upright 12 in positon and which will help to prevent rattling or other movement of the post.

To further aid in securely holding upright 12 in a generally stable, vertical, orientation, foot 23 pay be fitted with a series of pins 18 on its lower surface. In the attached drawings four such pins are shown, two on each end of foot 23. Other numbers of pins are contemplated. Where 4 pins are utilized, with two pins on each end of foot 23 (see FIGS. 19 and 20), the compression of bottom support 14 toward/against the upper surface of floor 2 will have the effect of applying a compressive force against foot 23 by virtue of the receipt of hook members 22 over foot 23. That compressive force will tend to drive pointed ends on pins 18 into the floor surface to better secure upright 12 in place. The compressive force may also tend to deflect the central portion of foot 23 toward the upper surface of floor 2 (see FIG. 21.2), thereby inducing a stress within foot 23, helping to secure upright 12 and helping to prevent rattling during operation and/or under wind loading.

Figure 2:
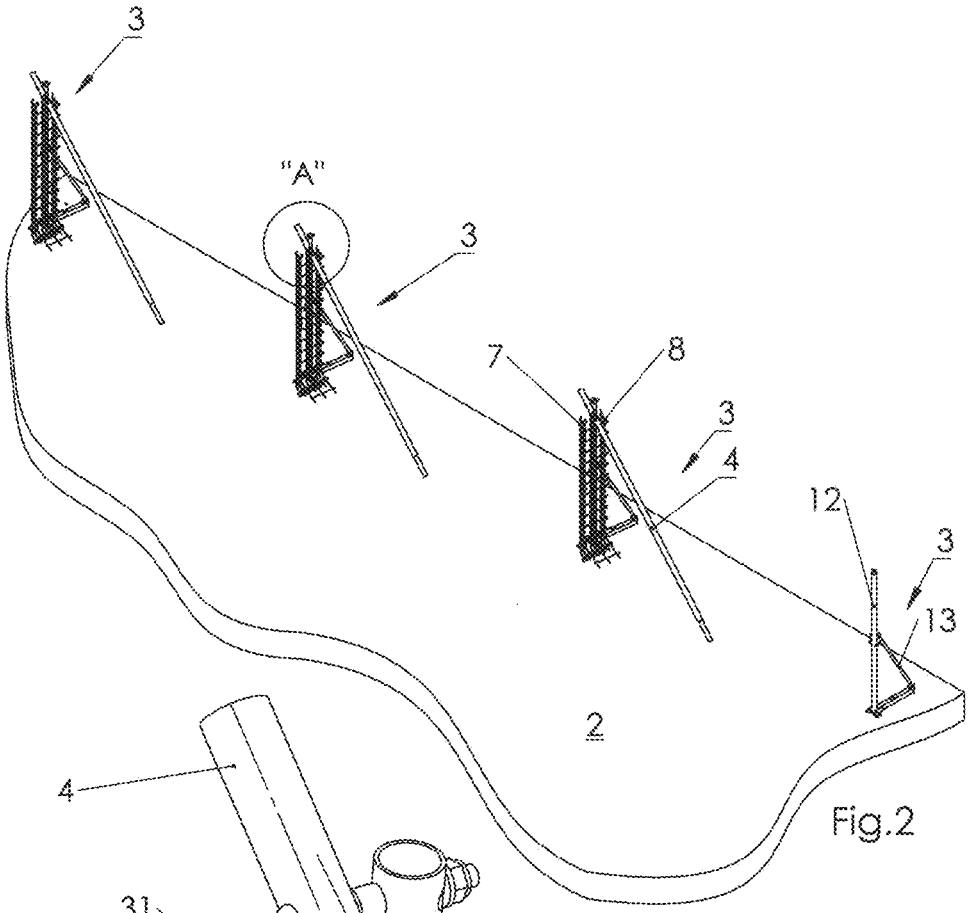
FIG. 2 is an upper side perspective view of an embodiment of the safety fence of the present invention wherein a series of fence posts have been mounted to a floor surface, prior to a complete erection of the fence.

When post 3 is initially secured to the upper surface of floor 2, mesh 7 will typically be in its stowed configuration and adjacent to upright 12. Rail 4 will typically at that point extend outwardly and away from upright 12 with its first end rotatably secured to the upper portion of upright 12 and its opposite end resting on the floor surface (see FIG. 2). In an embodiment, rail 4 may be telescopic to accommodate different horizontal offsets of first post 5 and second post to 6. The telescopic nature of rail 4 will thus permit its end opposite to that which is rotatably secured to first post 5 to be extended and to be releasably secured to adjacent second post 6. In this manner an industry customary spacing of posts 5 and 6 can be achieved, while still allowing for the presentation of a compact structure for storage and transportation by virtue of the ability of rail 4 to be telescoped into a shorter configuration. It will be appreciated that the manner of securing the rail to second post 6 can vary between a variety of different mechanical mechanisms that will be understood by one of ordinary skill in the art. In an embodiment of the invention, the outer end of rail 4 is fitted with a hook or opening that may be received about a pin or mating hook on an adjacent post.

Figures 4, 5, 6:
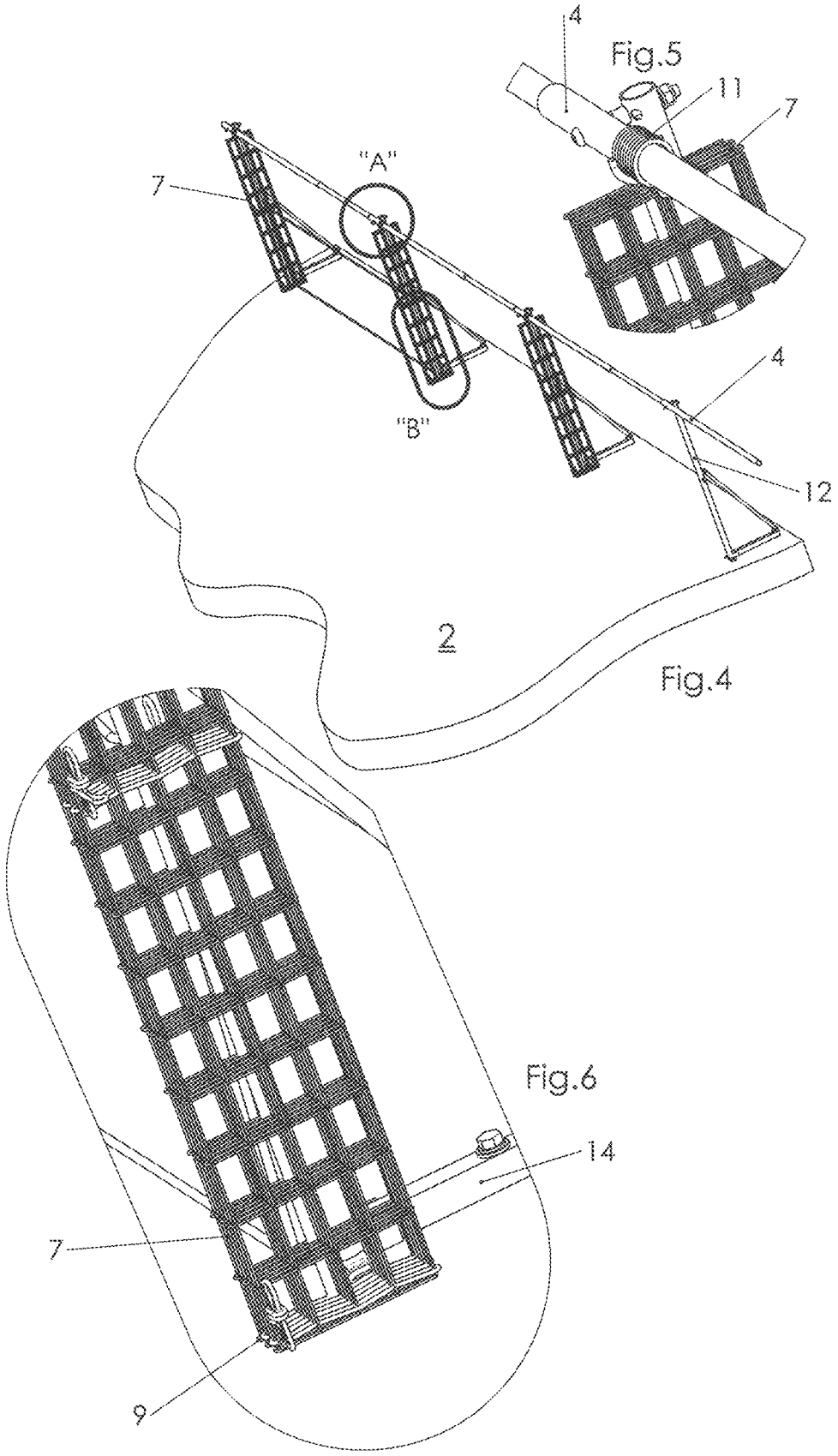
FIG. 4 is a view subsequent to FIG. 3, wherein the fence is in a partially erected configuration.
FIG. 5 is an enlarged detailed view of portion "A" of FIG. 4.
FIG. 6 is an enlarged detailed view of portion "B" of FIG. 4.

FIG. 4 demonstrates schematically the partial erection of safety fence 1, where four posts have been secured to floor 2, following which their rails 4 have been extended and secured between adjacent posts. As shown in FIG. 4, when extended and secured to adjacent posts the rails will generally line in the same vertical and horizontal planes.

Figure 7:
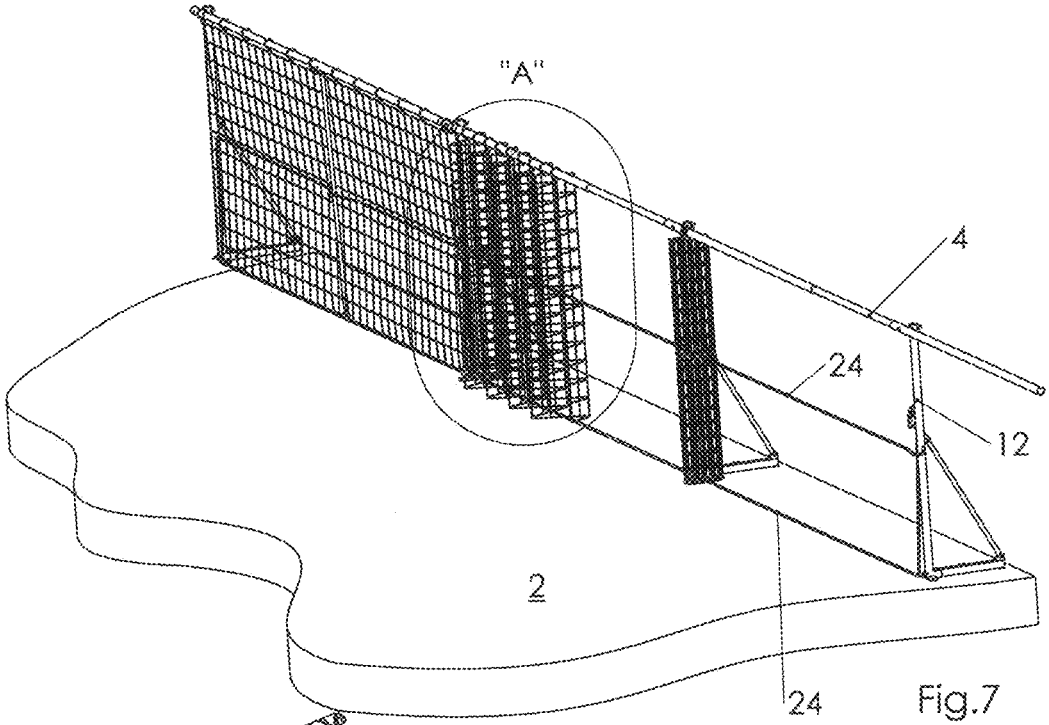
FIG. 7 is a view subsequent to FIG. 4, wherein the fence is in a further state of erection.
Figure 8:
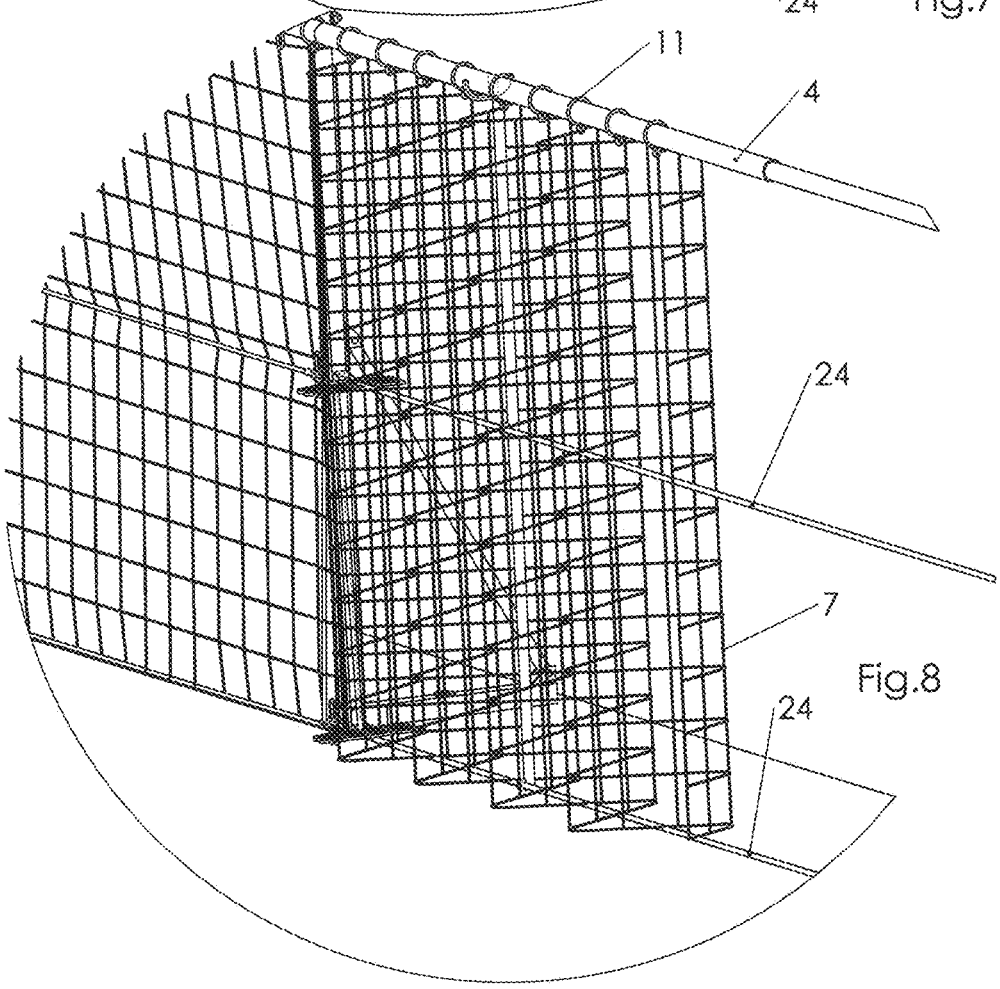
FIG. 8 is an enlarged detailed view of portion "A" of FIG. 7.
Figure 13:
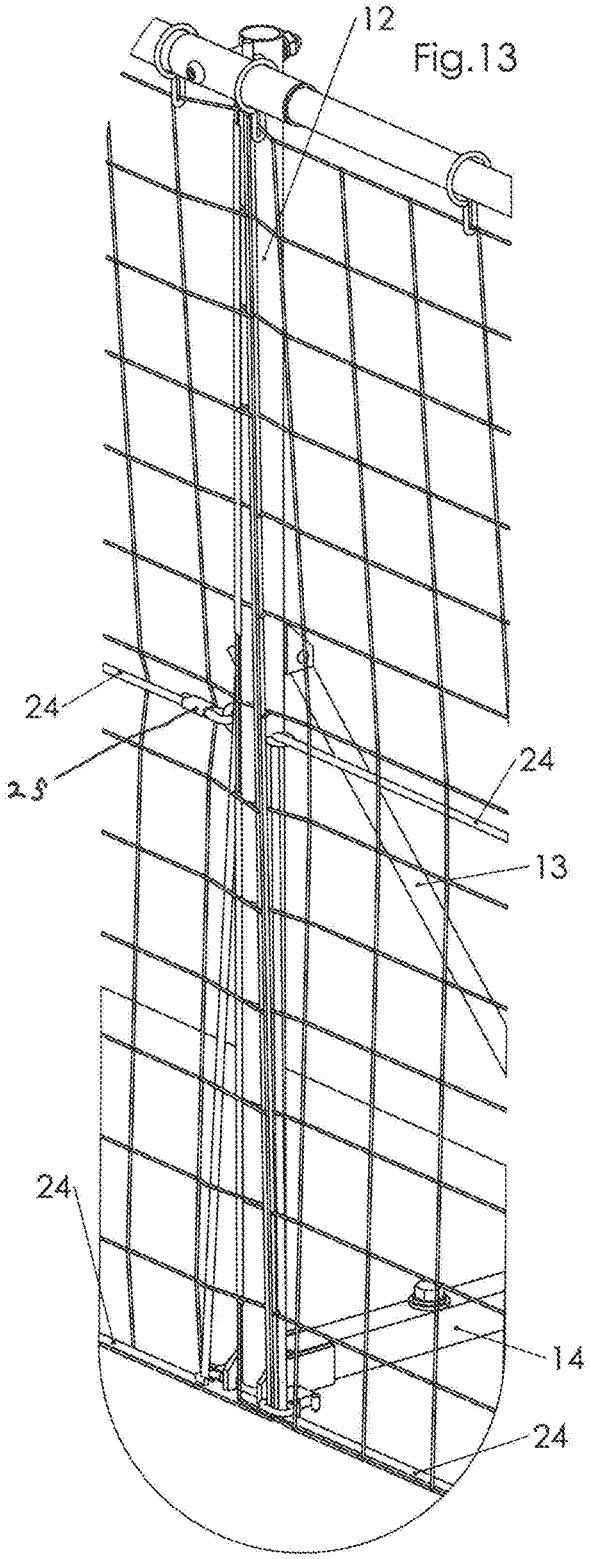
FIG. 13 is an enlarged detailed view of portion "D" of FIG. 9.

With post 3 and rails 4 in their erected configuration (as shown in FIG. 4) mesh 7 can be grasped and pulled horizontally with its upper end 8 slidably travelling along rail 4 as the mesh moves from its retracted configuration to its deployed configuration. At that point, the "free" end of mesh 7 (ie. that which is not rigidly secured to an upright 12 and that is grasped to slide the mesh along rail 4) can be releasably attached to an adjacent post or upright 12 to physically secure the mesh between the two adjacent posts in a taut manner (see generally FIGS. 7-9). The mesh may be releasably attached to the adjacent post through a variety of different mechanical means. In one embodiment, the mesh may be secured to an adjacent post through the use of a simple hook on the adjacent post, over which part of the mesh may be received. In another embodiment the mesh may be secured to the adjacent post through the use of straps, zip ties, or other forms of attachment or securing mechanism. The slidability of the mesh along upper rail 4 permits the fence to be easily erected and easily taken down and moved to a different floor or location.

In accordance with the invention, fence 1 further includes at least one tensioning member 24 having a first end 25 that is fixed or otherwise secured to an upright 12 of a post, and having a second end that is releasably securable to an adjacent post, such that the tensioning member may be tensioned between the two adjacent posts. When mesh 7 is in its deployed configuration with the tensioning member extended and tensioned between the two adjacent posts, the tensioning member 24 helps to provide horizontal load support to the mesh. To further support mesh 7, tensioning member 24 may be fed or threaded through openings in mesh 7, or otherwise slidably secured to portions of the mesh. The weaving of the tensioning member between the openings in mesh 7 or otherwise slidably securing it to the mesh may create a symbiotic relationship where the tensioning member helps to support the mesh and the mesh helps to support the tensioning member, such that the combined mesh/tensioning member structure has a greater horizontal load bearing capacity than either of the mesh or tensioning member individually.

In an embodiment, a single tensioning member may span between two adjacent posts at a point that is approximately midway between the bottom and top of the mesh. In an alternate embodiment, a single tensioning member may span between two adjacent posts at or near the bottom of the mesh. In yet a further embodiment, two tensioning members may be utilized, with one tensioning member positioned approximately midway vertically between the bottom and the top of mesh 7, and the other tensioning member positioned generally at or near the bottom of mesh 7.

Tensioning member 24 may be comprised of a cable, rope, strap, cord or other structure that can be retracted, or otherwise collapsed in some fashion, when the mesh is in its retracted configuration so that the tensioning member can be held in a position that is adjacent to upright 12. This further helps to present a compact fence component comprising folded post 3, rail 4, retracted mesh 7, and tensioning member 24. In an embodiment, tensioning member 24 may be a self-retracting coiled cable or rope. In a further embodiment the tensioning member could be a combination of a rigid structure (for example a rod) and a cable or a rope. In a further embodiment the tensioning member could be a rigid or semi-rigid rod or structure that is tensioned between two adjacent posts. Tensioning member 24 may also include a turn buckle, a ratchet mechanism, an elasticized member, a spring, or a variety of other features that could be utilized to "tension" the member between two adjacent posts.

In an embodiment of the invention tensioning member 24 may be a rope or cable that is fed back and forth between two adjacent posts. For example, first 3nd 25 of the rope or cable may be fixed to first post 5. The second end of the rope or cable may then be fed from first post 5 to second (adjacent) post 6 fed and through a hook, eyelet, or a similar structure on second post 6. The rope or cable can then be run along the surface of the post (ie. generally parallel to the post) to a different elevation, where it would typically engage a further hook, eyelet, or similar structure, at which point it can be then extended back across mesh 7 to first post 5. The rope or cable can then be placed in tension such that a single rope or cable effectively performs the function of two tensioning members that extend between the two adjacent posts at two different vertical elevations. In this embodiment the second end of the rope or cable can be releasably secured to first post 5 through a variety of different mechanical means, including but not limited to a cinch clamp or cinch mechanism 35 that holds the rope firmly in place and in tension between two adjacent posts. It will be appreciated that such a structure will present advantages in terms of cost and the speed and ease of installation. Various other configurations of tensioning members could be utilized while accomplishing the same general purpose and function.

Tensioning member 24 will not only provide horizontal load support to mesh 7, but will also provide a degree of horizontal rigidity to the uprights 12 of adjacent posts, in a direction parallel to the tensioning members. That is, an upright subjected to tensioning loads by tensioning members that are secured to each side of a post's upright, will have an increased rigidity in the direction of the tensioning members.

Safety fence 1 may further include a center support 27 having an upper end 28, that is slidably engagable with rail 4, and a lower end 29 that engages floor 2 (see in particular FIGS. 1, 9, 10 and 23). With center support 27 so engaged, and with rail 4 extending between two adjacent posts, the center support will provide vertical load support to rail 4, effectively enabling a more considerable span of rail 4 whilst maintaining vertical load requirements imposed by a jurisdiction. For example, it has been found that center support 27 can permit a spacing between adjacent posts of approximately 9 feet, while still providing the level of vertical load support required by most municipal authorities. Further, the slidable engagement of upper end 28 of center support 27 with rail 4 enables center support 27 to be slid along the rail with mesh 7. That is, where center support is secured or otherwise attached, connected or affixed to mesh 7, movement of the mesh from its retraced to its deployed configuration will automatically positon the mesh at the approximate mid-point of rail 4. Similarly movement of mesh 7 to its retracted configuration will move center support back to a position adjacent to the post to present a compact arrangement for transport and/or storage.

Figure 24:
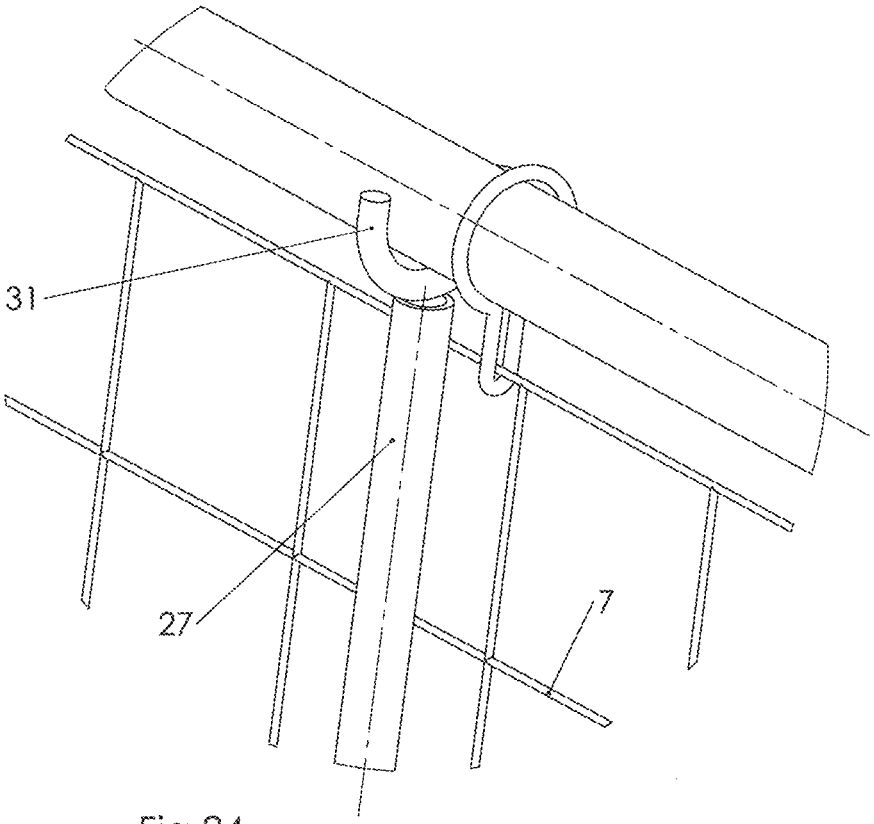
FIG. 24 is an enlarged detailed view of portion "A" of FIG. 23.
Figure 25:
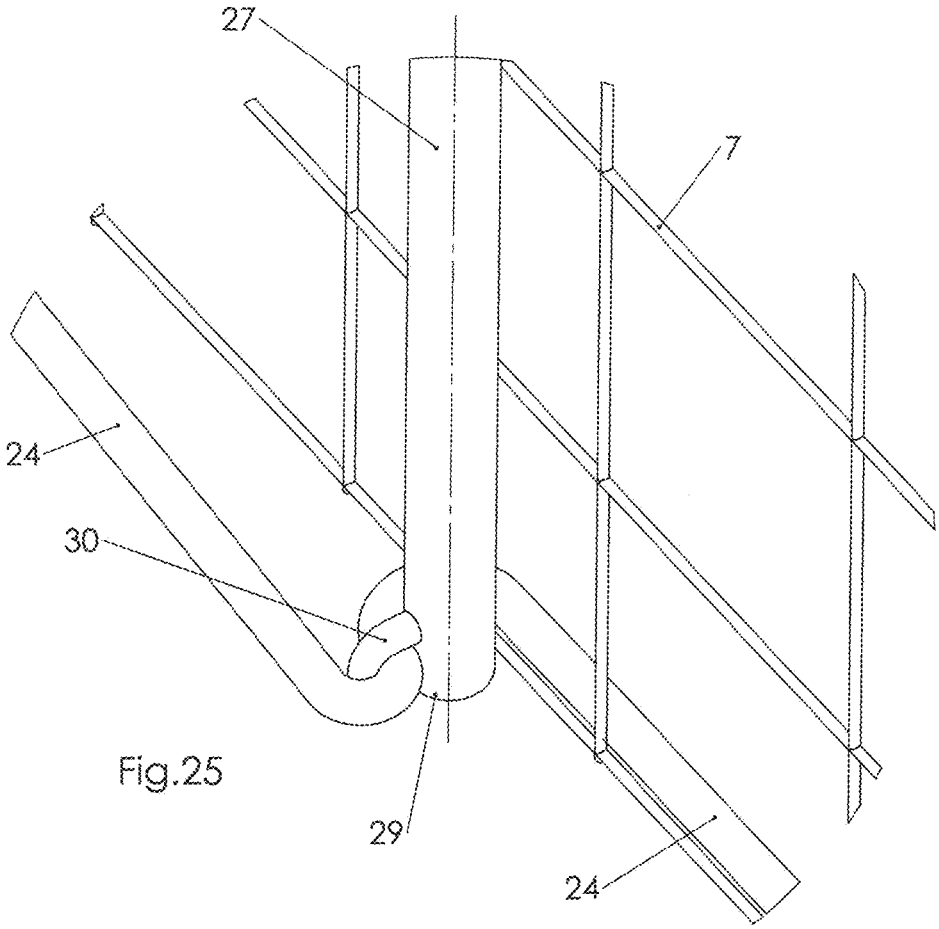
FIG. 25 is an enlarged detailed view of portion "B" of FIG. 23.
Figure 26:
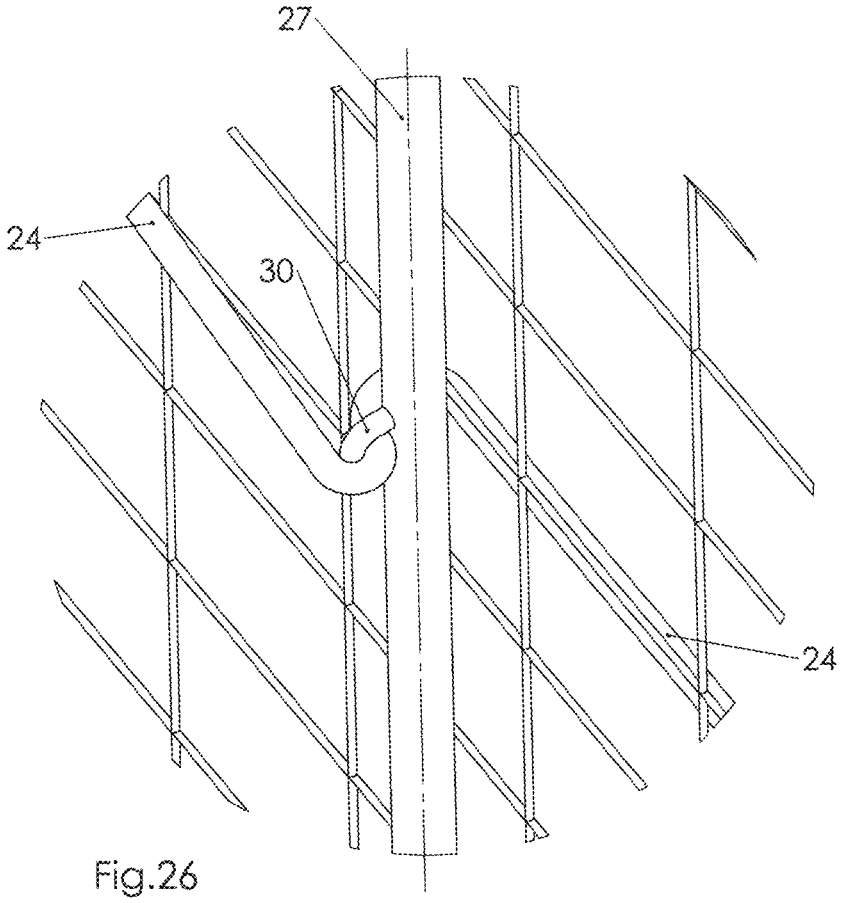
FIG. 26 is an enlarged detailed view of portion "C" of FIG. 23.

Center support 27 may be fed through openings in mesh 7. In an embodiment center support 27 may be fitted with rings or eyelets 30 through which a cable or rope comprising tensioning member 24 may be fed. In such an embodiment, the rope or cable, when tensioned between two adjacent posts, and when also fed through rings or eyelets 30, will help to provide horizontal load support to center support 27. In an embodiment of the invention the rope or cable comprising tensioning member 24 may be wrapped around center support 27 to provide additional horizontal rigidity to the center support 27. In an embodiment, upper end 28 of center support 27 may be fitted with a yoke-like structure 31 that is received about the exterior surface of rail 4 in order to both support the rail vertically and to allow center support 27 to slide horizontally along the rail (see FIG. 24).

In an embodiment, tensioning member 24 may be fed through a ring, hook, or similar structure at or near the bottom of center support 27 such that the center support will help to maintain the tensioning member in position at or near the floor surface when the tensioning member is tensioned between two adjacent posts. Similarly, a ring, hook, or similar structure may be positioned at or near the mid-point of center support 27 such that the tensioning member may be engaged with the center support at or near its mid-point in order to help to maintain the tensioning member at or near the mid-point of the center support when the tensioning member is tensioned between two adjacent posts.

From a thorough understanding of the above-described structure and that shown in the attached drawings, it will be appreciated that there is presented a safety fence that is compact, light in weight, and that may be easily stored and transported from location to location. The structure of fence 1 enables it to be erected and disassembled quickly, and with minimal tools. The fence is a self-contained structure that does not require additional components, aside from a means to anchor it to the floor of a building. To assemble the fence one merely needs to anchor or otherwise fasten a plurality of posts 3 to a surface, rotate upper rail 4 to a horizontal configuration and secure its fee end to an adjacent post, slide mesh 7 across from a first post to a second post and hook the mesh to the second post, and then draw tensioning member across the mesh from the first post to the second post and place the tensioning member in tension. Disassembly is just a simple with the above steps carried out in reverse. Once disassembled, post 3, together with rail 4, mesh 7, center support 27, and tensioning member 24 will be in a collapsed state that is compact and easy to transport or to store for future use.

Once assembled, the minimalistic structure provides a safety barrier to individuals, equipment, and materials along the edge of a floor of a building under construction. The assembled fence is also not significantly impacted by wind loading. The combination of mesh 7, rail 4, and tensioning member 24 presents a fence panel that is capable of accommodating horizontal loading to an extent that is necessary to satisfy jurisdictional regulations. Mesh 7, rail 4, and tensioning number 24 can be deployed or retracted easily, quickly, and without the use of tools, minimizing labor costs involved in the set up and take down of the fence. The materials from which safety fence 1 are constructed not only enable it to be light weight, but also enable it to be manufactured economically.

Certain adaptations and modifications of the described embodiments can be made. The above discussed embodiments are considered to be illustrative and not restrictive. For example, while the invention has been described for use in an edge protection system for multi-story construction, it will be appreciated that it could equally be used in a very wide variety of other applications, both construction and non-construction based. For example, it could be used in bridge construction, in residential construction, in crowd control applications, etc. It is also to be understood that what has been described are the preferred embodiments of the invention. The scope of the claims should not be limited by the preferred embodiments set forth above, but should be given the broadest interpretation consistent with the description as a whole.

What is claimed is:

1. A safety fence, the safety fence comprising:

a first post and a second post, each post releasably securable to a floor structure of a building or to another surface, an upper rail having a first end rotationally secured to an upright member of the first post, the upper rail having a second end releasably securable to an upright member of the second post to form a generally horizontally oriented support rail extending between the first and the second posts, the upper rail rotationally moveable about the first post to facilitate fence erection, removal, transportation, and storage, a collapsible mesh having an upper portion slidably coupled to the upper rail and having a first end fixedly secured to the first post, the mesh having a retracted configuration wherein it is collapsed and retained generally adjacent to the first post, the mesh having a deployed configuration wherein it has been slid along the upper rail such that the mesh is extended between the first and second posts with a second end releasably secured to the second post, the mesh slidably movable between its retracted and deployed configurations to facilitate fence erection, removal, transportation, and storage, at least one tensioning member having a first end fixed to the first post, the tensioning member releasably receivable with the second post such that the tensioning member may be tensioned between the first and second posts, when tensioned between the first and second posts with the mesh in its deployed configuration, the tensioning member providing horizontal load support to the mesh, the tensioning member extendible and retractable between the first and second posts to facilitate fence erection, removal, transportation, and storage.

2. The safety fence as claimed in claim 1 wherein the tensioning member is a cable, rope, strap, or cord, such that when the mesh is in its retracted configuration the tensioning member can be retracted to a position adjacent to the first post.

3. The safety fence as claimed in claim 2 comprising two tensioning members, when the tensioning members are extended between the first and second posts, one tensioning member positioned approximately midway vertically between the upper rail and a bottom of the mesh, and one tensioning member positioned generally at the bottom of the mesh.

4. The safety fence as claimed in claim 1 comprising a center support having an upper end slidably engaged with the upper rail, and having a lower-end for engaging the floor or other surface, when the upper rail extends between the first and second posts the center support provides vertical load support to the upper rail, the center support slidable along the upper rail for securement adjacent to the first post when the mesh is in its retracted configuration.

5. The safety fence as claimed in claim 4 wherein the tensioning member is engageable with the center support to provide horizontal load support to the center support.

6. The safety fence as claimed in claim 5 comprising two tensioning members extendable between the first and second posts, one tensioning member positioned approximately midway vertically between the upper rail and the bottom of the mesh and one tensioning member positioned adjacent to and engagable with the bottom of the mesh to provide horizontal load support to the bottom of the mesh.

7. The safety fence as claimed in claim 1 wherein the upright members include a foot for engaging the floor or other surface, when the upright member of a post is releasably secured to the floor or other surface a strain is induced within the foot to assist in holding the upright member rigidly in place.

8. The safety fence as claimed in claim 1 wherein the post members include a foot, the foot having a plurality of pins on a lower surface thereof, the pins engaging the floor to help secure the post thereto.

9. The safety fence as claimed in claim 1 wherein the upper rail is telescopic to accommodate different horizontal offsets of the first and second posts.

10. The safety fence as claimed in claim 1 wherein the upper rail is rotationally secured to the first post to permit the rail to be stowed adjacent to the first post during storage or transport of the first post.

11. The safety fence as claimed in claim 1 wherein the tensioning member is a single rope, strap, cable, or cord that, sequentially, is fed from the first post to the second post, that slidably engages a first location on the second post, that is fed adjacent to an exterior surface of the second post to slidably engage a second location of the second post that is at a different elevation than the first location, that is fed from the second post to the first post, that is tensioned between the first and second posts, and that is releasably secured to the first post.

12. The safety fence as claimed in claim 1 wherein the first and the second posts include a bottom support, the bottom support secured to the floor or other surface through use of a vertical tensioning post that is tensioned between the bottom support and a bottom surface of a floor immediately above.

13. A post for use in a safety fence, the post comprising:

an upright member releasably securable to a floor of a building or to another surface, an upper rail rotatably securable to the upright member such that the upper rail is rotatable to form a generally horizontally oriented support rail extending between the upright member and an adjacent post which is also releasably secured to the floor of the building or other surface, a collapsible mesh having an upper end slidably coupled to the upper rail, the mesh having a retracted configuration wherein it is collapsed and retained generally adjacent to the upright member, the mesh having a deployed configuration such that when the upper rail is horizontally oriented and extends to an adjacent post, the mesh is extended between the upright member and the adjacent post, at least one tensioning member having a first end fixed to the upright member and releasably securable to the adjacent post such that the tensioning member may be tensioned between the upright member and the adjacent post providing horizontal load support to the mesh when the mesh is in its deployed configuration.

14. The post as claimed in claim 13 comprising a bottom support and a brace, a first end of the brace rotationally secured to the upright member, a second end of the brace rotationally secured to a first end of the bottom support, a second end of the bottom support securable to the upright member, the bottom support having a first position wherein it is generally perpendicular to the upright member such that fastening the bottom support to the floor or other surface secures the upright member to the floor or other surface in a generally vertical orientation, the bottom support having a second position wherein both the bottom support and the brace are folded and lie generally adjacent and generally parallel to the upright member.

15. The post as claimed in claim 13 wherein the upright member includes a foot for engaging the floor or other surface, when the upright member is releasably secured to the floor or other surface a strain is induced within the foot to assist in holding the upright member rigidly in place.

16. The post as claimed in claim 13 wherein the post members include a foot, the foot having a plurality of pins on a lower surface thereof, the pins engaging the floor to help secure the post thereto.

17. The post as claimed in claim 13 comprising a center support having an upper end slidably engaged with the upper rail, and having a lower-end for engaging the floor or other surface, the center support slidable along the upper rail for securement adjacent to the upright member when the mesh is in its retracted configuration.

18. The post as claimed in claim 17 wherein the center support provides vertical load support to the upper rail when the center support is vertically orientated and when the upper rail is horizontally oriented and extends to an adjacent post.

19. The post as claimed in claim 18 wherein the tensioning member is engagable with the center support to provide horizontal load support to the center support when the tensioning member is under tension.

20. The post as claimed in claim 19 wherein the center support is secured to the mesh such that movement of the mesh from its retracted to its deployed configuration causes a positioning of the center support to or near a mid-point of the upper rail.

* * * * *